United States Patent [19]

Gref et al.

[11] 4,014,491

[45] Mar. 29, 1977

[54] ARRANGEMENT FOR ADJUSTING AND MEASURING WEB TENSION LEVELS

[75] Inventors: Hans Gref, Cologne; Wolfgang Schweicher; Hans Frenken, both of Leverkusen; Heinz Bussmann, Opladen; Karl Voss, Leverkusen; Helmut Schaffer, Opladen; Willi Junkersdorf, Monheim, all of Germany

[73] Assignee: AGFA-Gevaert, A.G., Leverkusen, Germany

[22] Filed: Nov. 6, 1974

[21] Appl. No.: 521,500

[30] Foreign Application Priority Data

Nov. 9, 1973 Germany ..... 2356009

[52] U.S. Cl. ..... 226/113; 226/195

[51] Int. Cl.[2] ..... B65H 17/42

[58] Field of Search ..... 226/44, 30, 42, 111, 226/113, 195; 242/75.3, 75.51, 190

[56] References Cited

UNITED STATES PATENTS

| | | | |
|---|---|---|---|
| 2,006,628 | 7/1935 | Cline | 242/75.3 |
| 2,544,467 | 3/1951 | Michel | 226/44 X |
| 3,013,707 | 12/1961 | Beachler | 242/75.3 X |
| 3,365,143 | 1/1968 | Espel | 242/75.51 |
| 3,667,664 | 6/1972 | Schroeder | 226/44 |
| 3,807,613 | 4/1974 | Holm | 226/44 |

*Primary Examiner*—Allen N. Knowles
*Attorney, Agent, or Firm*—Connolly and Hutz

[57] ABSTRACT

The tension level of moving webs of material is adjusted or measured and regulated by means of a guide roller mounted on parallel swing arms which include an angle $0 < \alpha < 90°$ with the horizontal, $\alpha$ lying in an angular range of $\pm 15°$ around the value $\alpha_M$ at which the traction applied to the web by the guide roller is at a minimum.

5 Claims, 5 Drawing Figures

ARRANGEMENT FOR ADJUSTING AND MEASURING WEB TENSION LEVELS

This invention relates to an arrangement for adjusting and measuring and regulating the tension level of moving webs of material. The arrangement includes at least one guide roller which is mounted for rotation on two parallel, torsion-resistant swing arms and around which the web of material is looped. The swing arms include an angle $0 < \alpha < 90°$ with the horizontal.

The precision with which webs of material are guided has to meet particularly stringent requirements in the manufacture of photographic papers and films. In this case, webs of film or paper coated on one side with the photographic emulsion have to be guided very long distances over rollers for drying purposes. In high-capacity production plants where the webs travel at high speeds, the distances required for drying can be as much as several hundred metres. The web has to be guided over a large number of rotatably mounted rollers which are accelerated by the web to a rotational speed proportional to the speed of the web. The web traction required to accelerate and overcome both the forces attributable to roller bearing friction and the compression resistance of the web increases with the number of rollers and the speed of the web.

In the high-capacity installations referred to above, the requisite web traction can become so high that it approaches the limit of the tear strength of the webs. In addition, the inertia of the installation interferes seriously with production. Accordingly, the single web drive has now been replaced by a drive which uses several drive rollers arranged along the path of the web. The interval between the web-drive rollers along the path of the web is governed by the mechanical properties of the web, in particular its thickness, width and stiffness. In general, the web traction (web tension) should not exceed a certain upper and lower limit. To this end, web traction was to be corrected at various points between the drives. The remaining tolerance range for web traction is then attributable solely to friction losses and to the compression resistance of the web. It is absolutely essential for the drives along the path followed by the web to be adapted to one another. In many cases, especially in the coating of paper webs, it is not sufficient to keep the peripheral speeds at a constant level, because changes in length (elongation and contraction) can occur during processing of the web. The rotational speeds then have to be readjusted accordingly to ensure that web tension will remains constant. To this end, it is necessary to install a high-precision control system. The error-sensing component of the control circuit is normally in the form of a so-called "dancer trolley" (cf. FIG. 1). This dancer trolley 1 is arranged between two drives 2 and 3 and consists of two guide rollers 4 and 5 which are supported by the web 6. The trolley 1 is vertically guided by rails. The traction (web tension) is adjusted by applying counterweights 7. When the trolley 1 moves upwards or downwards, an electrical displacement pickup 8 generates a signal which changes the rotational speed of the drive 2 in such a way that the drives 2 and 3 are again adapted to one another.

Although this measuring system has the advantage that it can also be used in the case of wet-coated webs, its mass results in such a high level of inertia that considerable acceleration forces are required. In addition, the guide for the dancer trolley has to be precision-machined which involves considerable expense. Another serious disadvantage is the high level of friction-induced losses during guiding of the dancer trolley. These friction losses result in an undesirably high hysteresis in the control curve.

Accordingly, the arrangement described above for measuring and adjusting web traction is only suitable for very wide and thick webs requiring very high tension levels for transport.

An object of the present invention is to provide arrangement for adjusting and measuring or regulating the level of tension in webs of material which is low both in inertia and in friction. It has been found that, in principle, these requirements can be satisfied by a guide roller mounted on swing arms. However, it is very important that the web traction should be substantially independent within a wide range of guide roller positions. This is necessary to ensure that the tension generated in the web of material by the guide roller remains constant within a relatively wide range. Since the arrangement according to the invention is to be used in particular in the manufacture of photographic products, it must be suitable for the use of wet-coated webs.

According to the invention there is provided an arrangement for adjusting or measuring and regulating the tension level of a moving web of material, comprising at least one guide roller mounted for rotation on two parallel torsion-resistant swing arms, the swing arms including an angle $0<\alpha<90°$ with the horizontal, wherein $\alpha$ is situated in an angular range of $\pm$ 15° around a value $\alpha_m$ at which the traction applied by the guide roller to the web is at a minimum. It has been found that this traction, as a function of $\alpha$, always passes through a minimum, and this minimum is surprisingly very flat. The term "flat minimum" means that the traction applied to the web changes very little in the vicinity of the minimum.

In one preferred embodiment of the invention, the swing arms are rigidly connected to a rotatably mounted tube. An extremely stable, torsion-resistant mounting for the guide roller is thus obtained.

As will be shown hereinafter, the traction applied to the web is governed by the weight of the guide roller and swing arms and by the geometric dimensions. Web tension can be increased by loading the swing arms with graduated, additional weights.

The rotatably mounted tube is advantageously provided with a potentiometer. The potentiometer converts the angle of rotation or angular position of the tube into a corresponding electrical signal which controls the drives for the web.

In another embodiment of the invention, the arrangement comprises two guide rollers mounted symmetrically with respect to one another. In this case, the two guide rollers are mounted on symmetrical swing arms.

The arrangement according to the invention has the advantages that it is highly sensitive and that a substantially constant tension level is maintained irrespective of the angular position of the guide roller. The inertia and friction losses are considerably reduced in relation to conventional systems. Another advantage is that the arrangement can be simultaneously used as a web store. Its storage capacity is determined by the neutral control position $\alpha_m$. The stored length of web derives from the difference for the web guide path at $\alpha = 0$ and $\alpha = \alpha_m$.

One embodiment of the invention is described by way of example below with reference to the accompanying drawings, wherein:

FIG. 1, described above, shows a known arrangement for producing constant web tension.

Figure 1:
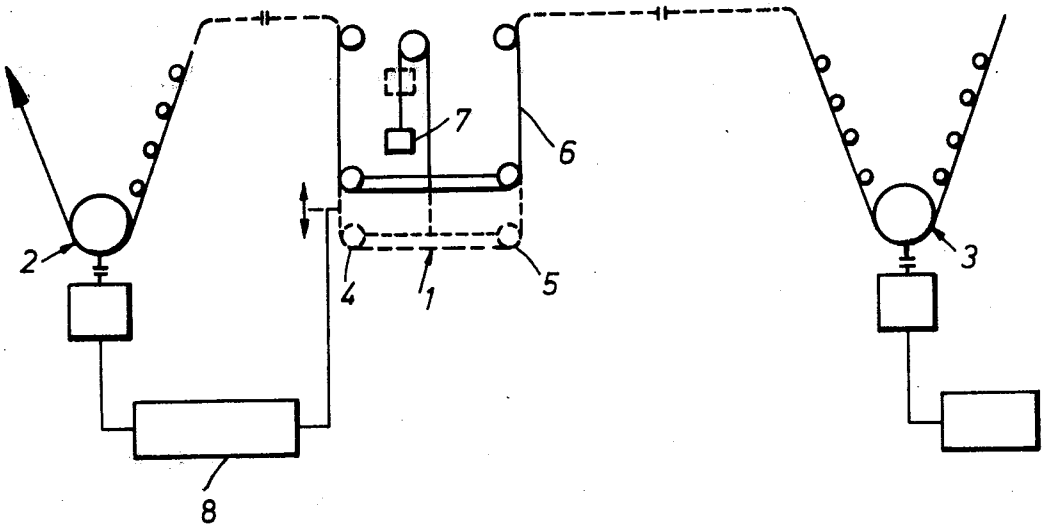
Figure 2:
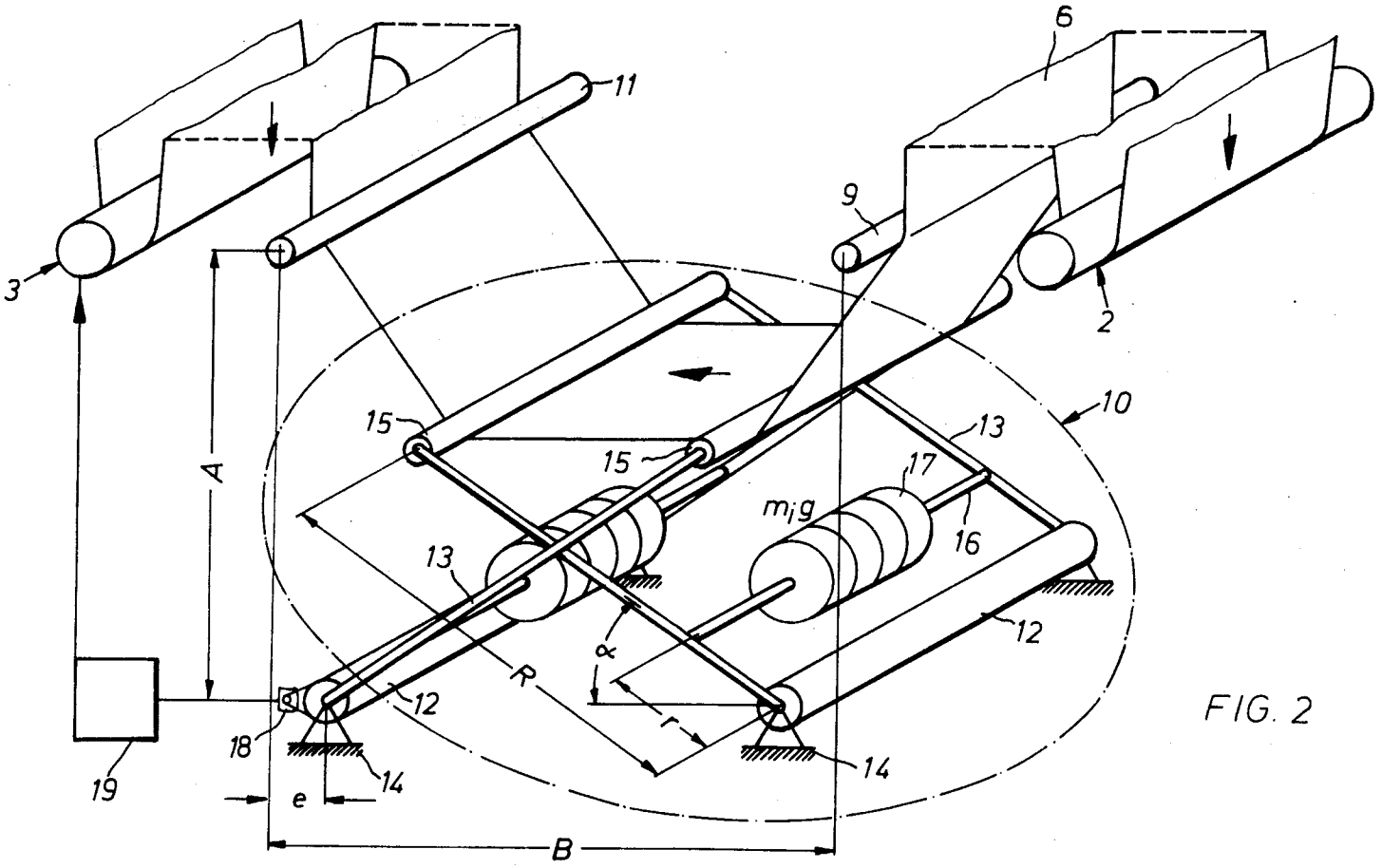
FIG. 2 is a perspective view of an arrangement according to the invention, with two guide rollers mounted symmetrically with respect to one another on swing arms.

The arrangement according to the invention is referred to below as a web-tension gauge. However, the arrangement according to the invention can be used not only for measuring web tension, but also for adjusting a constant web tension. As shown in FIG. 2, a web 6 of film travels downwards over a auxiliary guide roller 9 into a web-tension gauge 10 which it leaves via the second auxiliary guide roller 11. Accordingly, the web undergoes a total deflection of 180°. Most of this deflection takes place in the web-tension gauge 10 and, to a lesser extent, at the auxiliary guide rollers 9 and 11. Web-transport drives 2 and 3 are situated to the right and left, respectively, of the web-tension gauge 10.

The web-tension gauge 10 comprises two torsion-resistant tubes 12 to whose ends are fastened two swing arms 13. The tubes 12 are mounted for rotation on a base 14. Web guide rollers 15 around which the web 6 is looped are mounted at the free ends of the swing arms 13. Near their lower ends, the swing arms 13 are joined by a crossbar 16. The crossbar 16 can be loaded with additional weights 17, thus enabling web tension to be varied within wide limits. The mass of the swing arms 13 should be as low as possible to minimise the inertia of the system. However, provision must of course be made for adequate stability to ensure that the mounting of the rollers 15 is distortion-resistant.

One of the two tubes 12 is mechanically coupled to a potentiometer 18 which converts the angular position of the swing arms 13 with respect to the horizontal into a corresponding electrical signal. This signal is used for controlling one of the two drives (in this case the drive 3) by means of a control stage 19. If, for example, the drives 2 and 3 differ slightly from one another in their peripheral speed, the two swing arms 13 simultaneously pivot upwards or downwards. Pivoting of the swing arms results in precision correction of the rotational speed of the drive 3 through the control stage 19. The swing arms 14 then return to their neutral position.

One important requirement is that the traction applied by the guide rollers 15 to the web 6 should be substantially independent of the angular position $\alpha$ of the swing arms 13 within as wide a range as possible. It can immediately be seen that web tension becomes greater, the greater the natural weight of the web guide roller 15 and the greater the length of the swing arms 13. As a function of the angle $\alpha$, web traction passes through a minimum. It has now surprisingly been found that this minimum is very flat. If the value $\alpha_m$, at which web traction is at a minimum, is selected as the neutral control position, the requirement mentioned above can be satisfied very effectively. Closer consideration produces the following formula for the level of traction applied to the web by the arrangement:

$$\frac{S}{m_i g \cdot r/R} = \phi(\alpha) = \frac{\cos\alpha}{\sin\alpha + \cos\left(\alpha + \arctan\frac{B - e - R\cos\alpha}{A - R\sin\alpha}\right)}$$

$$S/(m_i g \cdot (r/R)) = \phi(\alpha) = \cos\alpha/(\sin\alpha + \cos\left(\alpha + \arctan\left(\frac{B - e - R\cos\alpha}{A - R\sin\alpha}\right)\right)$$

in which

| | | |
|---|---|---|
| S | [N] | = web traction |
| $m_i$ | [kg] | = reduced mass per arm and added mass per swing arm |
| g | [m/S²] | = gravitational acceleration |
| r | [m] | = ideal radius of the reduced mass |
| R | [m] | = length of one swing arm 13 |
| $\alpha$ | [o] | = angular position of the arms with respect to the horizontal |
| B | [m] | = interval between the rollers 9 and 11 |
| e | [m] | = eccentricity of arm mounting relative to the rollers 9 and 11 |
| A | [m] | = distance of the rollers 9 and 11 from the torsion tubes 12. |

It is assumed that the diameter of the rollers 9, 11 and 15 is small in relation to the distance A.

EXEMPLARY EMBODIMENT

| | | |
|---|---|---|
| Interval between rollers 9 and 11 | B = | 912 mm |
| Distance of the rollers 9 and 11 from the torsion tube 12 | A = | 1272 mm |
| Eccentricity | e = | −320 mm |
| Length of the arms 13 | R = | 1220 mm |

Figure 4:
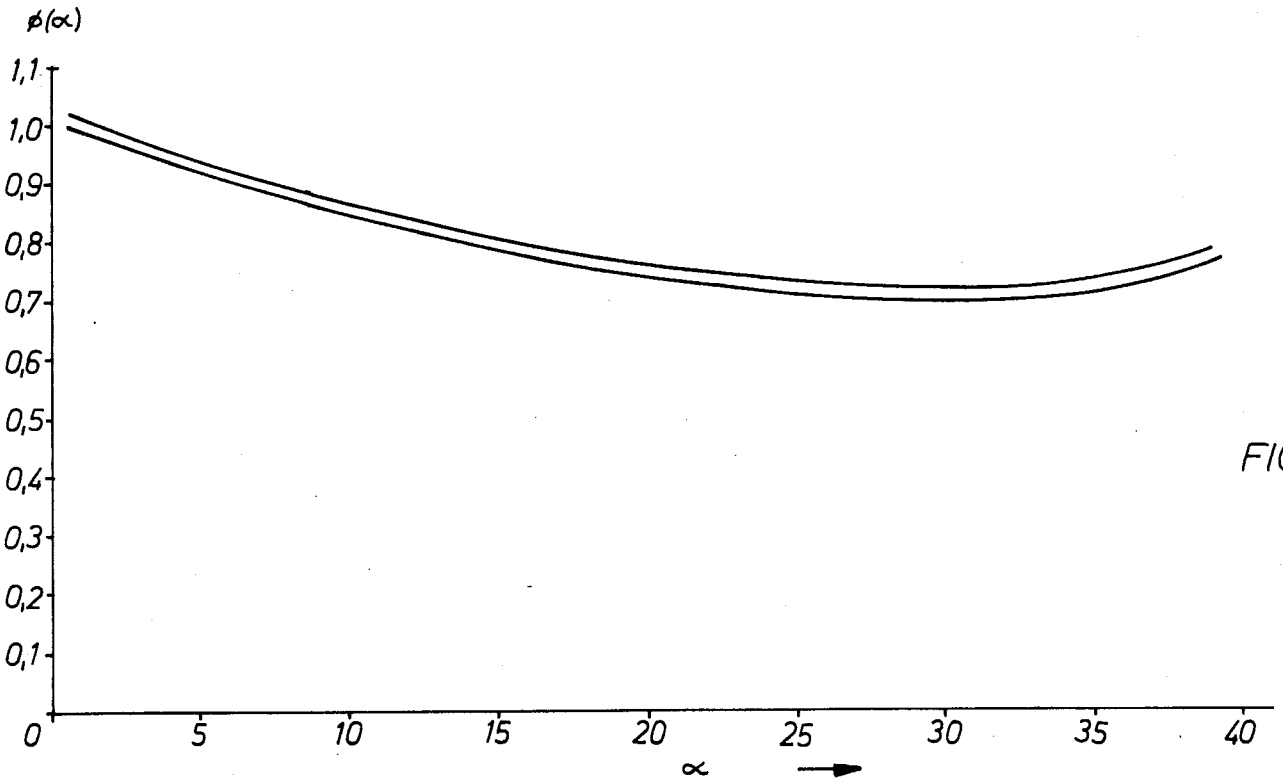
FIG. 4 shows the control characteristics, i.e., web traction, as a function of the position of the swing arms in the embodiment illustrated in FIG. 2.

The web traction made dimensionless with the value $m_i.g.r/R$:

$$\phi = S/(m_i.g.r/R)$$

is shown in FIG. 4. The upper curve shows web traction with the swing arms ascending, whilst the lower curve shows web traction with the swing arms descending. The curves were experimentally recorded and were consistent with the curves calculated from the above equation.

The area defined by the two curves is the already mentioned friction hysteresis. It is astonishingly low here and can be virtually ignored. It can also be seen that web traction undergoes hardly any change over a wide angular range of the swing arms 13. This ensures that the traction applied to the web by the arrangement always remains substantially constant. It also ensures that the arrangement in its capacity as a sensor for changes in web tension has a high level of sensitivity, because the angular position and, hence, the electrical signal tapped at the potentiometer 18, undergo marked changes in the event of only minor deviations of web traction from the ideal value. In practice, dimensioning is such that the swing arms 13 include the angle $\alpha = \alpha_m$ with the horizontal in the neutral control position. However, adjustment of the neutral control position is by no means critical by virtue of the shallow gradient of the curves in this zone. Deviations viations from $\alpha_m$ of the order of $\pm 10°$ are quite acceptable.

Figure 3:
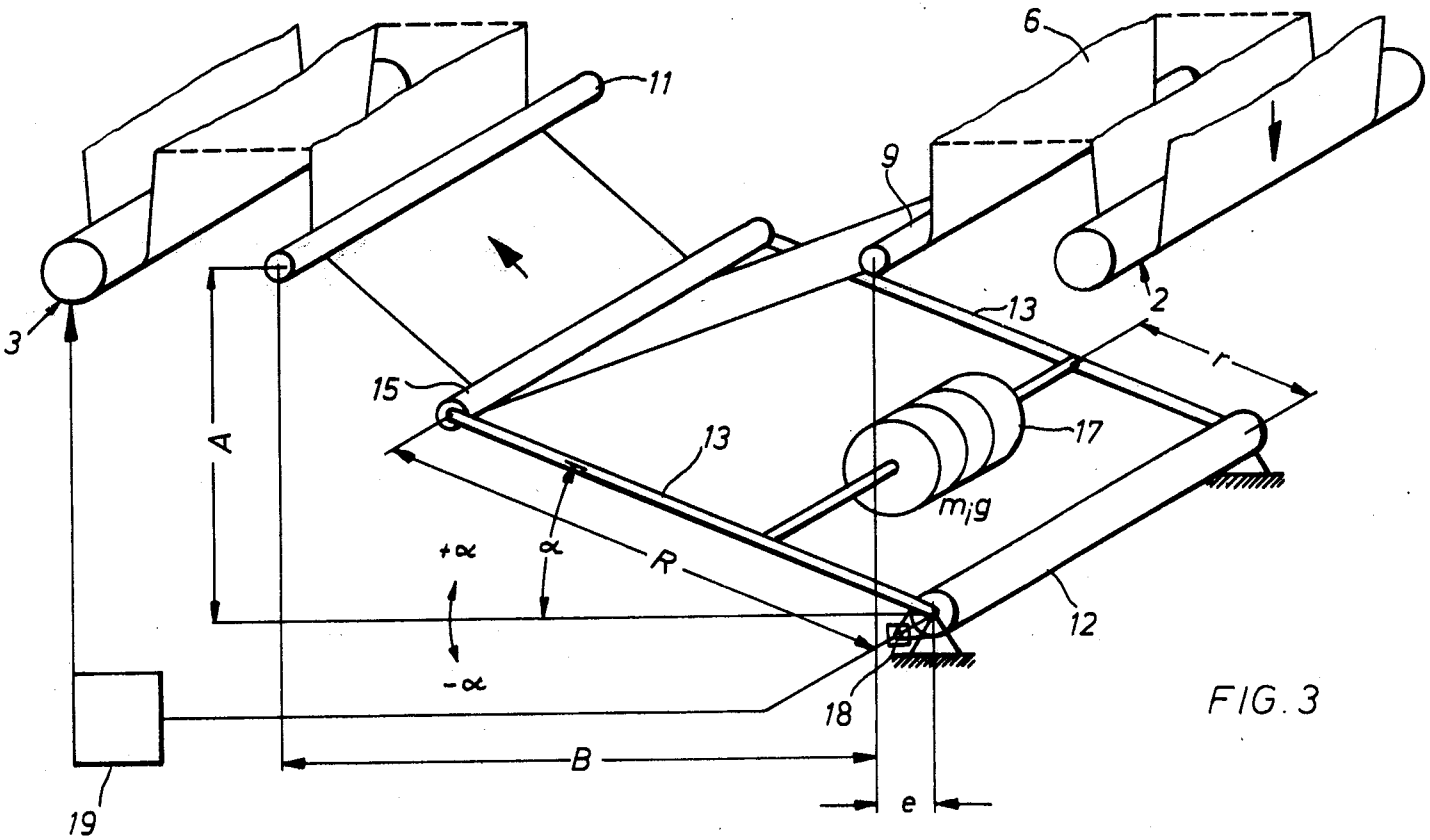
FIG. 3 shows an embodiment in which a single guide roller is mounted on a rotatable swing arm.

The embodiment illustrated in FIG. 3 is very similar in its function. However, it is simpler in structure than the first embodiment described above with reference to FIG. 2. Instead of two swing arms it only has one swing arm 13 with one guide roller 15. In addition, the embodiment illustrated in FIG. 3 has different geometric dimensions, the interval between the rollers 9 and 15 being narrower in the embodiment illustrated in FIG. 2 than in the embodiment illustrated in FIG. 3. It has been found that the arrangement shown in FIG. 2 is somewhat more suitable for webs with a marked tendency towards curling.

Figure 5:
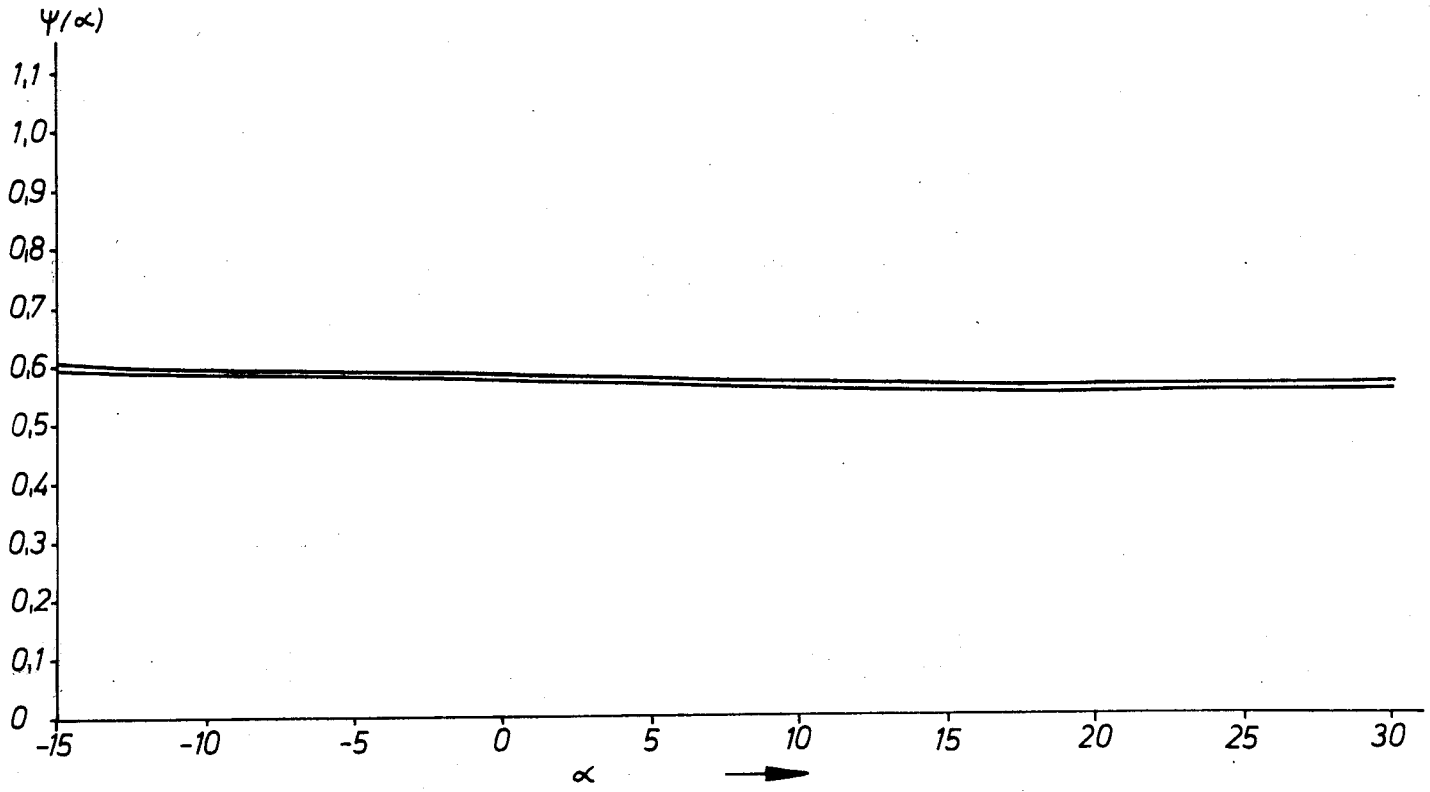
FIG. 5 shows the control characteristic for the embodiment illustrated in FIG. 3.

The traction applied to the web in the arrangement shown in FIG. 3 is calculated on the basis of the following equation:

is shown in FIG. 5. The upper curve again shows web traction with the swing arm ascending, whilst the lower curve again shows web traction with the swing arm descending. In this case, too, the experimentally determined curves coincided with the theoretically calculated curves. Since the curve $\psi(\alpha)$ is even flatter than $\psi(\alpha)$ in FIG. 4, the control range is even greater. In other respects, the two arrangements are comparable in regard to their advantages. The friction losses and moment of inertia are very low in both cases. Due to the reduction in friction losses, it is possible to reduce the number of drive rollers along the path followed by the web. Friction is virtually confined to the compression and bearing friction resistances of the web guide rollers. By virtue of the lower inertia forces, the web is also in far less danger of tearing. Another advantage of the arrangement according to the invention is that it is able to store quite a considerable length of web. The storage length substantially corresponds to the length of web released when the swing arms 13 are pivoted from the position $\alpha = 0$ into the neutral control position $\alpha = \alpha_m$.

Finally, another significant factor is that the arrangement according to the invention is inexpensive and is sufficiently compact to make it readily possible for it to be stored in existing installations.

$$\psi(\alpha) = S/(m_i g r/R) = \cos\alpha/(\mathrm{Sin}\left(\arctan\frac{A - R\sin\alpha}{B + e - R\cos\alpha}\right) + \mathrm{Sin}\left(\arctan\frac{A - R\sin\alpha}{R\cos a - e} + \alpha\right)$$

in which

| | | |
|---|---|---|
| S | [N] | = web traction |
| $m_i$ | [kg] | = reduced mass of the arm and added mass |
| g | [m/S²] | = gravitational acceleration |
| r | [m] | = ideal radius of the reduced mass |
| R | [m] | = length of the swing arm |
| $\alpha$ | [o] | = angular position of the arms with respect to the horizontal |
| B | [m] | = interval between the rollers 9 and 11 |
| A | [m] | = distance of the rollers 9 and 11 from the torsion tube 12 |
| e | [m] | = eccentricity of the axis of rotation |

EXEMPLARY EMBODIMENT

| | | |
|---|---|---|
| Interval between the rollers 9 and 11 | B = | 1000 mm |
| Distance of the rollers 9 and 11 from the torsion tube 12 | A = | 1000 mm |
| Length of the arms 13 | R = | 950 mm |
| Web width | T = | 200 mm |
| Web thickness | t = | 150 $\mu$m |
| Eccentricity | e = | 0 mm |

11

The dimensionless web tension $$\psi(\alpha) = S/(m_i g\ r/R)$$

What we claim is:

1. An arrangement for adjusting and regulating the tension level of a moving web of material, comprising at least one guide roller disposed in contact with the moving web of material, which turns around the guide roller, the guide roller being mounted for rotation on two substantially parallel torsion-resistant swing arms, the swing arms being disposed of an angle $\alpha$ with the horizontal, wherein $\alpha$ is situated in an angular range of $\pm 15°$ relative to an angle $\alpha\ m$ which is defined by the position of the guide roller or rollers at which the tension in the web is a minimum.

2. An arrangement as claimed in claim 1, wherein the swing arms are rigidly connected to a rotatably mounted tube.

3. An arrangement as claimed in claim 1, wherein the swing arms are loaded by graduated additional weights.

4. An arrangement as claimed in claim 2, wherein the rotatably mounted tube is provided with a potentiometer which converts the angle of rotation $\alpha$ of the tube into a corresponding electronic signal.

5. An arrangement as claimed in claim 1 comprising two symmetrically mounted guide rollers.

* * * * *

UNITED STATES PATENT AND TRADEMARK OFFICE

CERTIFICATE OF CORRECTION

PATENT NO. : 4,014,491

DATED : March 29, 1977

INVENTOR(S) : Hans Gref, Wolfgang Schweicher, et al

It is certified that error appears in the above-identified patent and that said Letters Patent are hereby corrected as shown below:

Cover page, column 1, in the inventors column, change

"Helmut Schaffer" to -- Helmut Schäffer --

Column 5, change the following formula:

$$\text{"}\psi(\alpha)=S/(m_i gr/R)=\cos\alpha/(\mathrm{Sin}\left(\arctan\frac{A-R\sin\alpha}{B+e-R\cos\alpha}\right)+\mathrm{Sin}\left(\arctan\frac{A-R\sin\alpha}{R\cos\alpha-e}+\alpha\right)\text{"}$$

to $$\psi(\alpha)=S/(m_i gr/R)=\cos\alpha/(\mathrm{Sin}\left(\arctan\frac{A-R\sin\alpha}{B+e-R\cos\alpha}-\alpha\right)+\mathrm{Sin}\left(\arctan\frac{A-R\sin\alpha}{R\cos\alpha-e}+\alpha\right.$$

Signed and Sealed this twenty-third Day of August 1977

[SEAL]

Attest:

RUTH C. MASON
*Attesting Officer*

C. MARSHALL DANN
*Commissioner of Patents and Trademarks*